US005228525A

United States Patent [19]

Denney et al.

[11] Patent Number: 5,228,525

[45] Date of Patent: Jul. 20, 1993

[54] ADAPTOR FOR EARTH BORING MACHINE

[75] Inventors: Robert D. Denney, Ashland; Michael D. Howman; Ronald E. Peacock, both of West Salem, Ohio

[73] Assignee: Augers Unlimited, Inc., Ashland, Ohio

[21] Appl. No.: 485,465

[22] Filed: Feb. 27, 1990

[51] Int. Cl.[5] ..... E21C 1/10

[52] U.S. Cl. ..... 175/122; 173/154; 175/171

[58] Field of Search ..... 175/62, 113, 122, 170, 175/171, 203, 162; 173/152, 154, 160

[56] References Cited

U.S. PATENT DOCUMENTS 3,162,254 12/1964 Rose ..... 173/154
3,612,194 10/1971 Richmond ..... 175/122
3,612,195 10/1971 Richmond ..... 175/122
3,693,734 9/1972 Richmond ..... 175/122
3,851,716 12/1974 Barnes ..... 175/45
3,870,110 3/1975 Richmond et al. ..... 173/163
4,013,134 3/1977 Richmond et al. ..... 175/73
4,329,887 5/1982 Kawamoto ..... 74/467

*Primary Examiner*—Ramon S. Britts
*Assistant Examiner*—David J. Bagnell
*Attorney, Agent, or Firm*—Reese Taylor

[57] ABSTRACT

An adaptor assembly for an earth boring machine includes a thrust bearing housing removably attachable to the bulkhead plate of an earth boring machine surrounding the torque hub flange. A rear drive flange is attached to the torque hub and a front drive flange is mounted within the housing and carries a thrust bearing movable into and out of contact with the housing. The front drive flange has an extension which projects beyond the housing for attachment of an auger and boring head and is connected to the rear drive flange for rotational movement therewith and axial movement relatively thereof.

21 Claims, 4 Drawing Sheets

ADAPTOR FOR EARTH BORING MACHINE

RELATED PATENT APPLICATIONS

None.

BACKGROUND OF THE INVENTION

This invention relates, in general, to earth boring machines of the type adapted for the horizontal boring of shafts wherein horizontal holes are created by advancing the machine carrying a boring head into the earth. Sections of pipe casing are then pushed into the holes thus formed. The invention relates, in particular, to an adaptor assembly which renders such an earth boring machine operative when moving into the bore and also when being extracted from the bore while protecting the gear box from damage.

DESCRIPTION OF THE PRIOR ART

It is well-known that, in certain instances, it is undesirable to excavate trenches for the laying of pipes or pipelines for various purposes, such as sewers, utilities, etc., due to the particular location of the same. For example, where the bore is required to be situated under existing structure, such as a highway, for example, it is undesirable to destroy the highway by excavating from the surface and then patching or replacing the surface structure after the cavity or bore has been constructed and the pipe laid.

In these situations, the solution is to bore horizontal shafts beneath the surface of the earth without disturbing the surface structure. This generally consists of inserting an auger, to which a boring head is attached, through the interior of a section of pipe casing, with the boring head projecting from the forward end of the casing. The boring head is then rotated to excavate the dirt, rock, etc., and bore the hole. The excavated material or spoil is removed back through the pipe casing with the auger serving as a conveyor for the spoil or other material thus removed from the bore. Simultaneously, with the boring operation, the casing is advanced into the bore by a pusher.

This pusher generally includes spaced track members which are disposed in a trench adjacent to the starting point of the bore in axial alignment with the projected bore. A power train for rotating the auger and boring head, including a transmission and gear reduction box, is supported on a carriage which is mounted on the rails or track members for movement therealong and a pusher ring for driving sections of the casings into the bored holes is also provided on the machine.

This type of operation is normally adequate, and the gear box is generally designed to provide sufficient torque for the boring operation and to withstand such forces as may be encountered in the boring operation as the apparatus is advanced into the bore.

In certain instances, however, it is believed desirable to make it possible to continue excavation of the bore as the boring apparatus is withdrawn from the bore as well as when it is advanced into the bore. For example, when boring through rock, it is extremely difficult to guide the boring machine precisely and since, in many instances, the grade of the bore is critical, it is sometimes the case that, when the machine reaches the outboard end of the bore, it is found that the bore is slightly off-grade. In those instances, it would be advantageous to be able to effectively regrade the bore as the boring machine is extracted from the hole.

In still other instances, it is sometimes desirable to further enlarge the diameter of the bore in a second operation and, by making it possible to continue the boring operation on the withdrawal movement, there would be no reduction of efficency since the machine has to be extracted from the bore anyway.

The difficulty encountered, however, in attempting to perform these operations on the return or withdrawal movement with conventional boring equipment is that, if this is attempted without any modification of the machine, the forces encountered in pulling, as contrasted to those encountered in pushing, the machine with the auger and boring head rotating and engaging the soil are so great that the gear box would most likely be destroyed.

Therefore, it is desirable to provide adaptor means requiring a minimum modification to a conventional boring machine and permitting the machine to operate effectively, both during the time it is being pushed into the bore and during the time it is being pulled from the bore.

SUMMARY OF THE INVENTION

It, accordingly, becomes the principal object of this invention to provide an adaptor assembly which can be attached with a minimum amount of modification to a conventional boring machine which permits the machine to operate effectively in a reverse direction or as it is being pulled from the bore while protecting the gear box from damage from the forces encountered during such movement.

In furtherance of this object, it has been found that, by providing a bearing housing which can readily be secured to the conventional bolster plate of the machine, replacing the usual master casing housing, such a bearing housing can permit the auger to be rotated in the conventional fashion from the gear box, while protecting the gear box from the sometimes excessive forces encountered during pulling.

It has further been found that, by employing a bearing housing of this type with a thrust bearing mounted interiorly thereof and connected for rotational movement with the torque hub extension but independent axial movement with respect thereto, the forces encountered in pulling will be transmitted to the bearing and to the bearing housing, bypassing the torque hub and the gear box and thereby avoiding damage thereto.

Accordingly, production of an adaptor assembly for mounting on an earth boring machine to permit the same to be operated in conventional fashion when boring into the hole as well as when being withdrawn from the hole without damage to the drive train becomes the principal object of this invention with other objects thereof becoming more apparent upon a reading of the following brief specification considered and interpreted in view of the accompanying drawings.

BRIEF DESCRIPTION OF THE PREFERRED EMBODIMENTS

Figure 1:
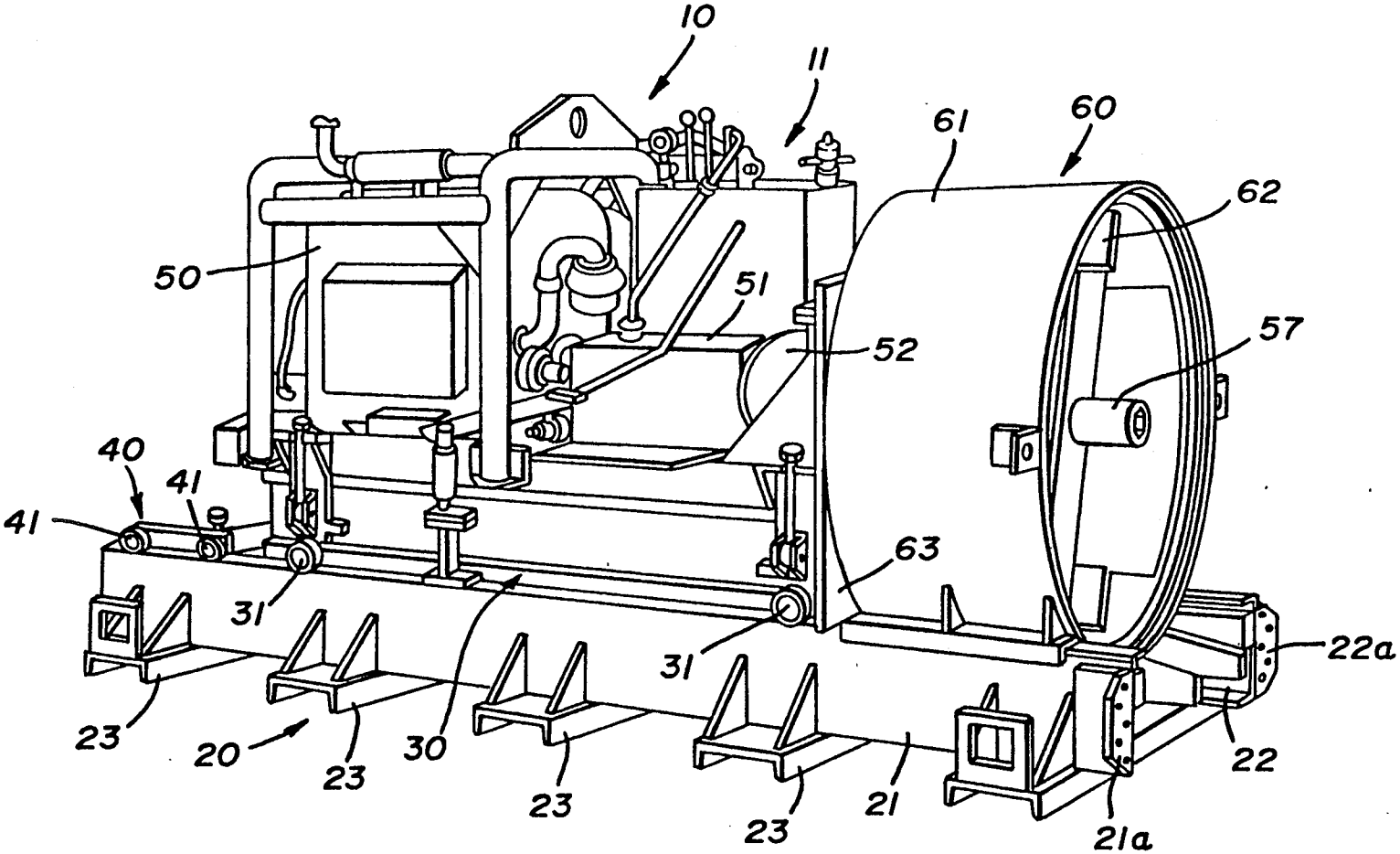
FIG. 1 is a perspective view of a conventional earth boring machine.

Turning to FIG. 1, it will be noted that this figure illustrates a conventional boring machine of the type shown, for example, in Richmond U.S. Pat. Nos. 3,612,194 and 3,612,195. The machine thus illustrated will be described herein, although not in great detail, since the above-referenced patents, which are incorporated herein by reference, clearly describe the detailed construction of such a machine, and the detailed construction of such a machine is generally well-known in the art.

Turning to FIG. 1 then, it will be noted that the boring machine, generally indicated by the numeral 10, includes power means indicated by the arrow 11 and a base assembly indicated by the arrow 20.

The base assembly 20 includes parallel rails 21 and 22 which have flanges 21*a* and 22*a* on one end thereof and which are mounted on transverse frame members 23,23. The flanges 21*a* and 22*a* are provided so that additional rail sections can be secured as the machine is progressively inserted into the bore being drilled as previously mentioned.

Mounted on the base assembly 20 is a carriage assembly 30 which receives the drive means, which will be described below, and which has a plurality of rollers 31,31 which permit it to advance along the top of the rails 21 and 22, as is well-known in the art.

Mounted on the carriage are the power means 11 which include, normally, an internal combustion engine 50 connected to a transmission 51 and a gear reduction unit or gear box 52. The purpose of the internal combustion engine 50 and the drive train associated therewith is to rotate the auger and boring head (not shown) as the machine is advanced toward and through the bore and thus to excavate the bore.

Also carried for movement along the rails 21,22 of the base assembly 20 is a cylinder base assembly 40 which carries double acting power cylinders (not shown). The cylinder base assembly 40 has rollers 41,41 also for movement along the rails 21,22, and the cylinders provide the push force which drives the machine into the bore. They are not illustrated herein or described in detail since they are conventional and clearly illustrated in the Richmond patents previously mentioned. Suffice it to say, for purposes of this invention, the cylinders provide the pushing and pulling force to either drive the machine 10 toward and into the bore or to pull it back through and from the bore.

Mounted on the right-hand end of the boring machine 10 illustrated in FIG. 1 of the drawings is a master casing pusher ring assembly 60 which includes an annular guard 61 and whose main purpose is to receive the casings and drive them into the bore as the boring head creates the bore and as the auger removes the spoil therefrom. This master casing is bolted or otherwise secured to a mounting bracket and bulkhead plate assembly 63. A torque hub flange 53 (see FIG. 3) projects from the gear reduction unit 52 through the bulkhead plate 63 and carries a spoil ejector 62 which ejects the dirt or other debris through an opening in the annular guard 61. The opening is not shown, but it is conventional in apparatus of this type.

In operation of the device shown in FIG. 1 of the drawings, it is simply necessary to mount the auger and boring head on the extension 54, which projects from torque hub flange 53, and to insert a pipe casing in the ring 60. At that time, the engine 50 is activated and, through the transmission 51 and gear reduction unit 52, causes the auger and boring head to rotate, creating the bore. During this operation, the hydraulic cylinders push the entire assembly along the tracks 21,22 so that the bore is eventually constructed to its desired length. Detail as to the conventional operation of a device of this type is believed well-known and will not be entered into here.

Figure 2:
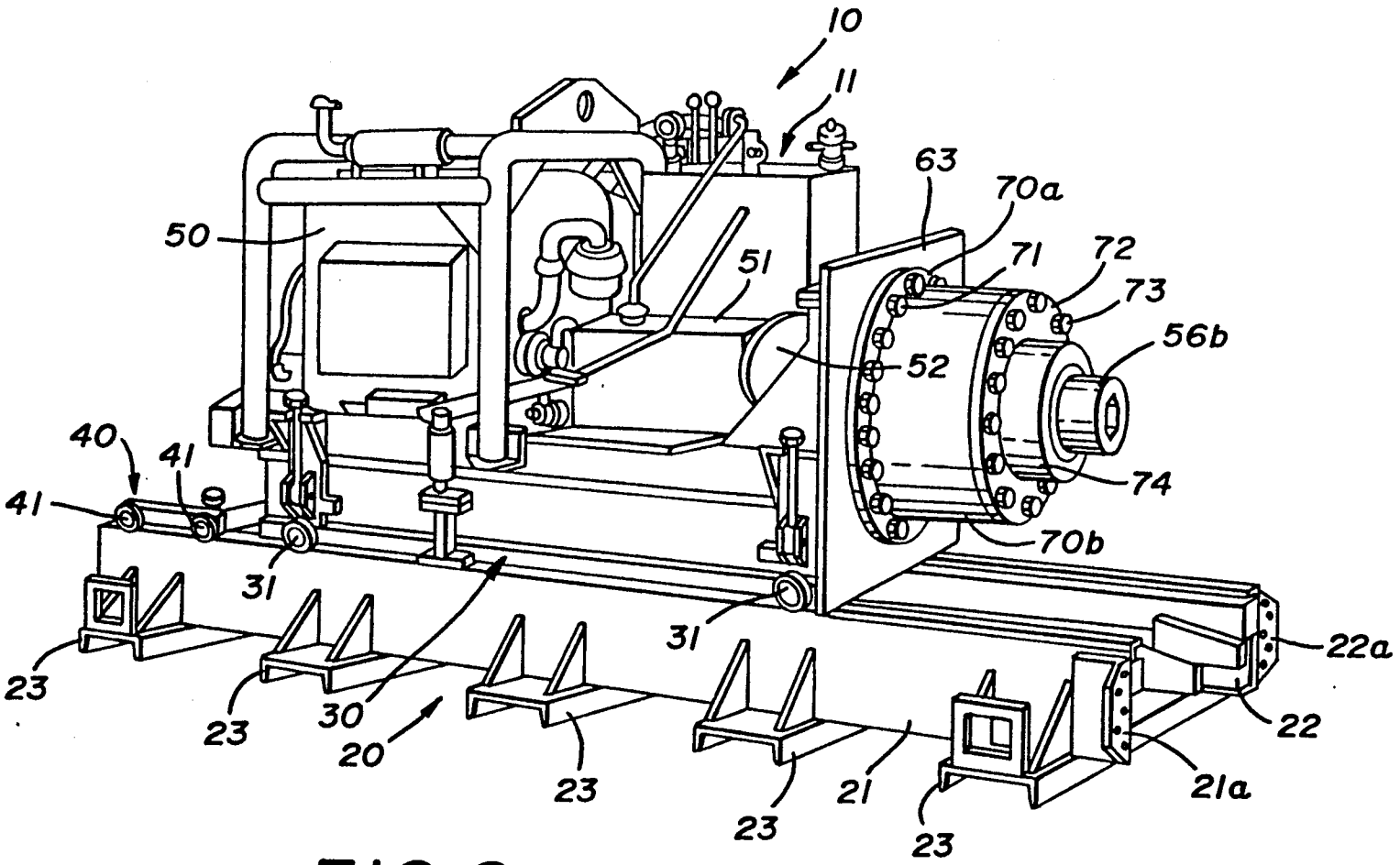
FIG. 2 is a perspective view similar to FIG. 1, but showing the adaptor assembly of this invention mounted on a conventional boring machine.

FIG. 2 of the drawings illustrates the identical boring machine 10 as illustrated in FIG. 1 of the drawings, but with the master casing pusher ring assembly 60, the annular guard 61 and the spoil ejector 62 removed and the adaptor assembly, which is the subject of this invention, substituted therefor.

Figure 3:
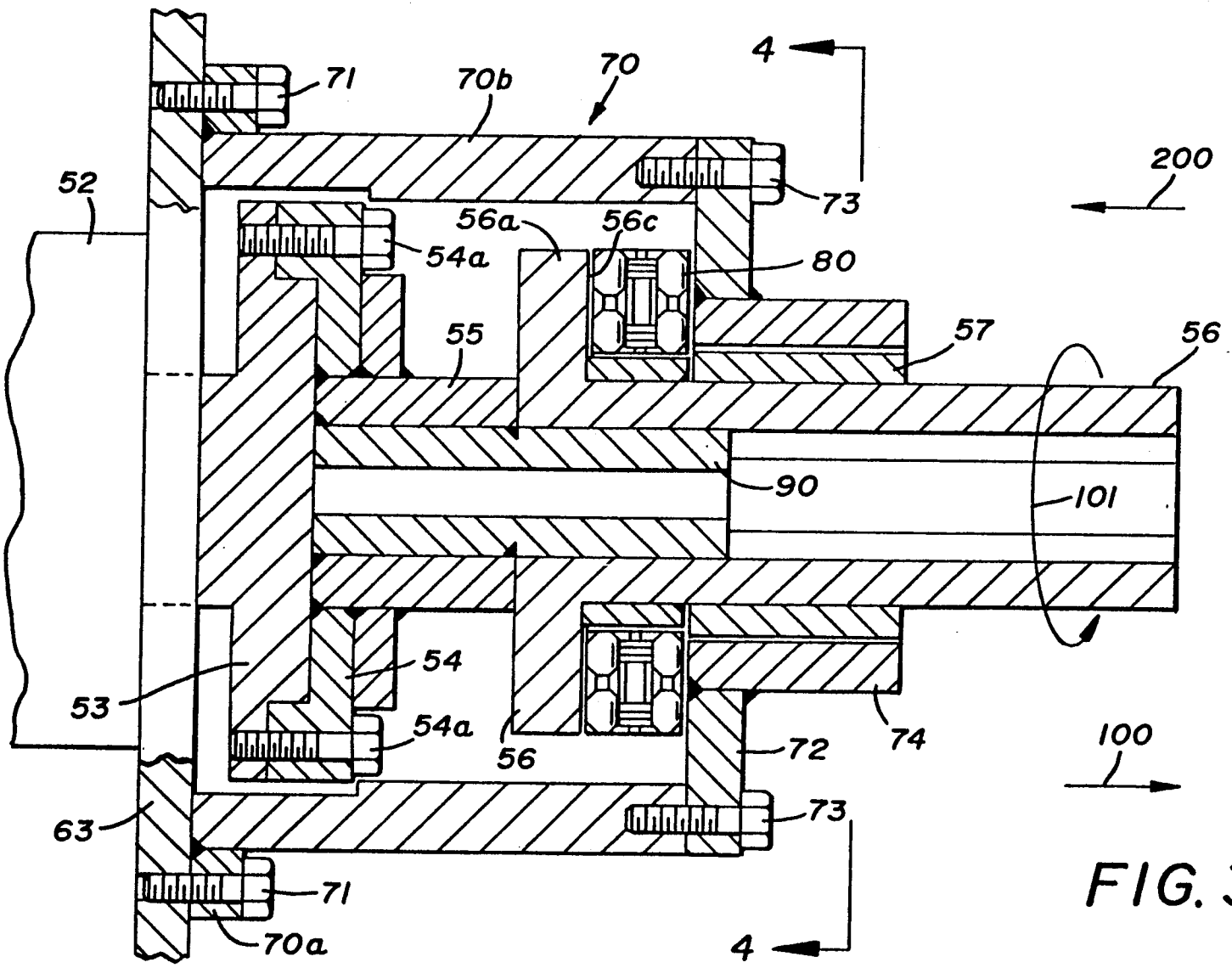
FIG. 3 is an elevational view, partially in section, showing the adaptor assembly in detail.
Figure 4:
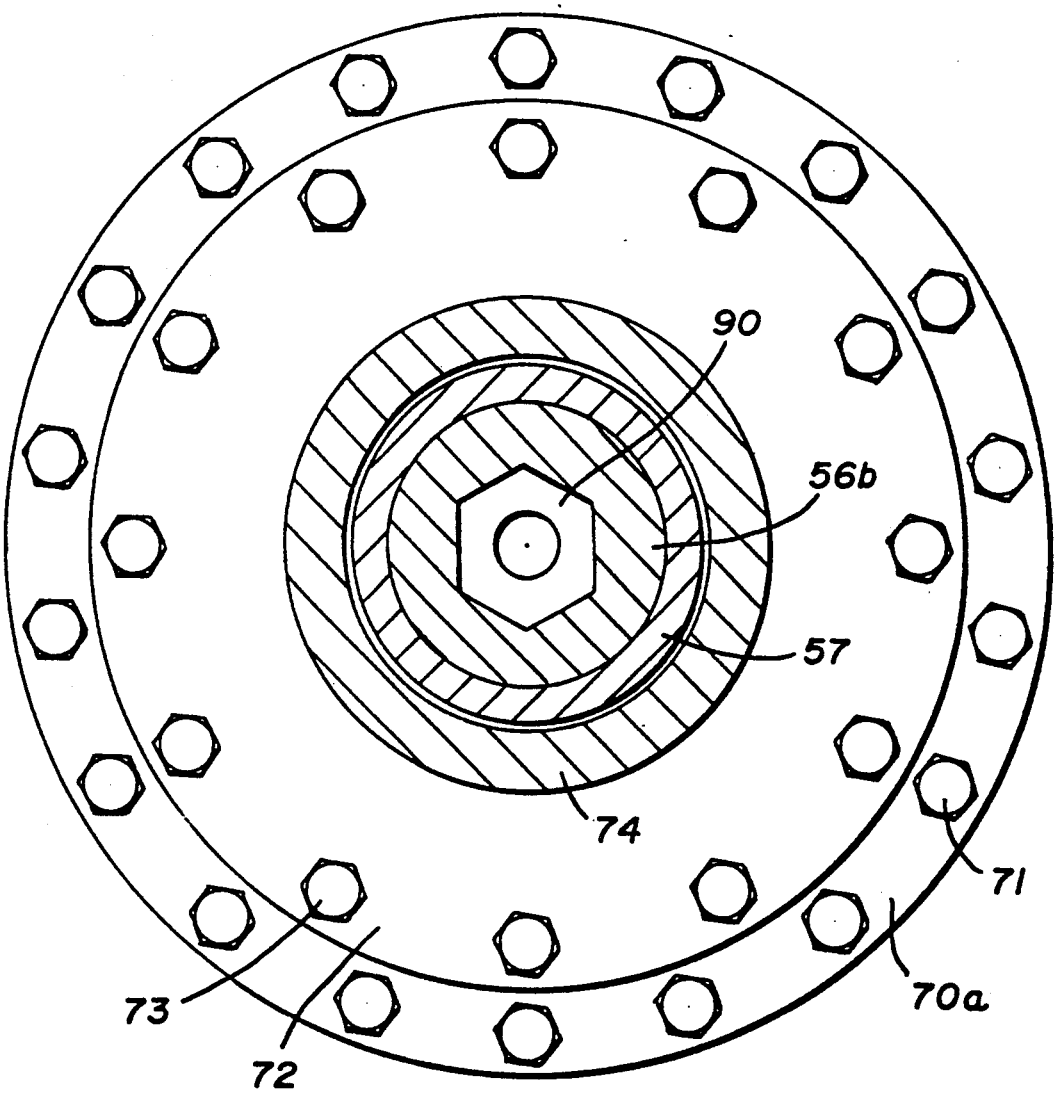
FIG. 4 is a sectional view, taken along the line 4—4 of FIG. 3.

It will be noted from FIG. 3 of the drawings that the adaptor assembly itself generally includes a thrust bearing housing 70 which includes an enlarged annular flange 70*a* which is bolted by the means of the bolts 71,71 to the bulkhead plate 63. This housing 70, in addition to the flange 70*a*, has a cylindrical body 70*b* which projects away from the bulkhead plate 63 and receives, on its outboard end, a bearing housing cap 72 which is secured thereto by bolts 73,73.

Received internally of the bearing housing 70 is the conventional torque hub flange 53 which has a rear drive flange 54 bolted thereto by bolts 54*a*,54*a*. This rear drive flange 54 also has an output drive extension 55 projecting axially outwardly and secured thereto as by welding or other suitable means. At this point, it should be understood that, upon activation of the engine 50, the torque hub flange 53, the rear drive flange 54 and the extension 55 would be driven in the direction of arrow 101, as will be described. Since extension 55 is operatively connected to the auger and boring head, rotational movement for excavating purposes will be accomplished regardless of the use of the adaptor assembly of this invention. It will also be noted, however, that the components just described are received interiorly of the bearing housing 70 and, as will be described, are connected to other components of the adaptor assembly only for rotational movement therewith.

To that end, a front drive flange 56 is provided, and this front drive flange has an enlarged base 56*a* and an elongate, cylindrical extension 56*b* which substitutes for the extension 57 of the conventional machine and projects through the bearing housing cap 72 for ultimate connection with the auger and boring head.

This front drive flange 56, having the previously mentioned enlarged base 56*a*, forms a seat 56*c* which receives a thrust bearing 80. The thrust bearing 80, it will be noted, is disposed between the flange base 56*a* and the bearing housing cap 72. It is also normally spaced therefrom slightly, as can be seen in FIG. 3 of the drawings.

Telescoped interiorly of both the output drive extension 55 of the rear drive flange 54 and the front drive flange 56 and its extension 56*b* is an elongate bar 90. Preferably, this bar has a hexagonal outer configuration, and the inner configuration of the output drive extension 55 and the front drive flange 56 and extension 56*b* is also hexagonal. Bar 90 is welded or otherwise fixed to extension 55 of rear drive flange 54 and is slidingly received in front drive flange 56. This facilitates assembly and permits torque to be transmitted from the torque hub flange 52 to the front drive flange 56 so that the auger and boring head, which are attached to the projecting end 56*b* of the front drive flange, can be rotated. However, it will be noted here that the front drive flange 56 is also movable axially, independently of the torque hub due to its sliding engagement with bar 90.

In that regard, it will be noted that when, for example, the boring machine 10 is moved into the bore in the direction of the arrow 100, only the normal design torque forces are encountered and no damage is envisioned to the gear box and drive train. However, when the machine 10 is moved in the direction of the arrow 200, or, in other words, out of the bore, "pull" forces will be encountered. As previously noted, the torque hub flange 53 and gear box 52 cannot withstand these forces in normal operation and would tend to be damaged thereby.

However, when the adaptor assembly of the present invention is in place, as the machine 10 is pulled in the direction of the arrow 200, the pull forces will be taken up by, first, the front drive flange 56 and the thrust bearing 80. These forces will tend to pull the front drive flange 56 and the bearing 80 into engagement with the inner wall of the bearing housing cap 72. Pull forces will then be transmitted to the housing cap 72 and through the housing 70 to the bulkhead plate 63. None of these forces will be transmitted to the torque hub flange 53 and thus to the gear box 52 and transmission 51.

It should also be noted that there may be, on occasion, a problem with wobble at the outboard of the extension of the front drive flange 56. To that end, it will be noted that the bearing housing cap 72 has an outboard extension 74, telescoped around a portion of the extension 53*b* of the front drive flange 56. Received therebetween is a wear bushing 57 of brass or some other suitable material which serves to maintain this extension and thereby the auger and boring head which are attached thereto in a true or centered coaxial condition for more accurate boring.

In addition to the operational advantages achieved by the adaptor assembly of the present invention as just described, it will also be seen that all that is required to convert a conventional boring machine is to simply remove the main casing housing assembly 60 and its associated components and tap and bore suitable holes for reception of the bolts 71, 71 to the bulkhead plate 63. At that time, the adaptor assembly of the present invention can be mounted thereto, and the machine is suitable for effective operation in the pulling mode as well as in the usual pushing mode. Of course, no permanent structural change is effected, because, if it is desired to use the machine 10 in conventional fashion, it is simply necessary to unbolt the adaptor assembly and reattach the conventional apparatus illustrated in FIG. 1.

While a full and complete description of the invention has been set forth in accordance with the dictates of the Patent Statutes, it should be understood that modifications thereof can be restored to without departing from the spirit hereof or the scope of the appended claims.

What is claimed is:

1. An adaptor for an earth boring machine having means for rotating an auger and boring head through a transmission, gear reduction unit, torque hub, and torque hub flange and having a bulkhead plate disposed between the transmission and gear reduction unit and the torque hub flange, the machine being movable into and out of the bore, comprising:

(a) a bearing housing attachable to the bulkhead plate on the side opposite the transmission and gear reduction unit;

(b) said bearing housing extending outwardly from the bulkhead plate and surrounding the torque hub flange;

(c) bearing means carried within said bearing housing in encircling relationship with the torque hub flange; and (d) said bearing means being movable axially relative to the torque hub flange and into bearing engagement with said bearing housing upon movement of the machine out of the bore whereby pulling forces are transmitted to the bulkhead plate.

2. The adaptor of claim 1 wherein said bearing housing includes:

(a) a flange for attachment to the bulkhead plate;

(b) a housing body projecting axially from said flange;

(c) a housing cap secured to the projecting end of said housing body; and (d) said bearing means are received within said housing body adjacent said housing cap.

3. The adaptor of claim 2 wherein said bearing means include a front drive flange received within said cylindrical housing body; and a bearing carried by said front drive flange between said flange and said housing cap.

4. The adaptor of claim 3 wherein connector means are received by said torque hub flange and said front drive flange whereby they may be rotated together.

5. The adaptor of claim 4 wherein said connector means include an elongate bar fixed to said torque hub flange and connected to said front drive flange; said bar engaging said front drive flange for rotational movement therewith; said front drive flange being movable axially relatively of said bar.

6. The adaptor of claim 5 wherein a rear drive flange is connected to said torque hub flange; and said bar is fixed to said rear drive flange.

7. The adaptor of claim 6 wherein said bar has a hexagonal cross-section; and said rear drive flange and said front drive flange have coaxial hexagonal bores for receipt of said bar.

8. The adaptor of claim 4 wherein said front drive flange includes an axially projecting extension extending through said housing cap; and said housing cap has an axially projecting extension for receipt of said extension of said front drive flange.

9. The adaptor of claim 8 wherein a bushing is disposed between said extensions of said front drive flange and said housing cap.

10. The adaptor of claim 1 wherein said bearing means are rotatable with said torque hub and movable axially independently thereof.

11. An adaptor for an earth boring machine having means for rotating an auger and boring head through a transmission, gear reduction unit, torque hub, and torque hub flange and having a bulkhead plate, the machine being movable into and out of the bore, comprising:

(a) a bearing housing attachable to the bulkhead plate;

(b) said bearing housing extending outwardly from the bulkhead plate and surrounding the torque hub flange;

(c) bearing means carried within said bearing housing in encircling relationship with the torque hub flange;

(d) said bearing means being movable axially relative to the torque hub flange;

(e) a rear drive flange attached to the torque hub flange;

(f) a front drive flange received within said bearing housing and carrying said bearing means;

(g) connector means fixed to said rear drive flange and connected to said front drive flange for rotation therewith; and (h) said front drive flange being movable axially with respect to said connector means.

12. The adaptor of claim 11 wherein said housing has an axial extension projecting from its outboard end; said front drive flange has an axial extension received within said extension of said housing; and a bushing is received between said extension of said front drive flange and said extension of said housing.

13. An adaptor for an earth boring machine having means for rotating an auger and boring head through a transmission, gear reduction unit, torque hub, and torque hub flange and having a bulkhead plate, the machine being movable into and out of the bore, comprising:

(a) a bearing housing attachable to the bulkhead plate;

(b) said bearing housing extending outwardly from the bulkhead plate and surrounding the torque hub flange;

(c) bearing means carried within said bearing housing in encircling relationship with the torque hub flange;

(d) said bearing means being movable axially relative to the torque hub flange;

(e) a flange for attachment to the bulkhead plate;

(f) a housing body projecting axially from said flange;

(g) a housing cap secured to the projecting end of said housing body; and (h) said bearing means are received within said housing body adjacent said housing cap.

14. The adaptor of claim 13 wherein said bearing means include a front drive flange received within said cylindrical housing body; and a bearing carried by said front drive flange between said flange and said housing cap.

15. The adaptor of claim 14 wherein connector means are received by said torque hub flange and said front drive flange whereby they may be rotated together.

16. The adaptor of claim 15 wherein said connector means include an elongate bar fixed to said torque hub flange and connected to said front drive flange; said bar engaging said front drive flange for rotational movement therewith; said front drive flange being movable axially relatively of said bar.

17. The adaptor of claim 16 wherein a rear drive flange is connected to said torque hub flange; and said bar is fixed to said rear drive flange.

18. The adaptor of claim 17 wherein said bar has a hexagonal cross-section; and said rear drive flange and said front drive flange have coaxial hexagonal bores for receipt of said bar.

19. The adaptor of claim 15 wherein said front drive flange includes an axially projecting extension extending through said housing cap; and said housing cap has an axially projecting extension for receipt of said extension of said fron drive flange.

20. The adaptor of claim 19 wherein a bushing is disposed between said extensions of said front drive flange and said housing cap.

21. The adaptor of claim 13 wherein said bearing means are rotatable with said torque hub and movable axially independently thereof.

* * * * *

UNITED STATES PATENT AND TRADEMARK OFFICE

CERTIFICATE OF CORRECTION

PATENT NO. : 5,228,525

DATED : July 20, 1993

INVENTOR(S) : Robert D. Denney et al.

It is certified that error appears in the above-identified patent and that said Letters Patent is hereby corrected as shown below:

In Column 8, line 30, delete "fron" and substitute therefor ---front---.

Signed and Sealed this

Fifth Day of April, 1994

Bruce Lehman

*Attest:*

BRUCE LEHMAN

*Attesting Officer*

*Commissioner of Patents and Trademarks*